US006435499B1

(12) United States Patent
Tomatsu

(10) Patent No.: US 6,435,499 B1
(45) Date of Patent: Aug. 20, 2002

(54) SHEET FEEDER

(75) Inventor: Yoshiya Tomatsu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 57 days.

(21) Appl. No.: 09/643,734

(22) Filed: Aug. 23, 2000

(30) Foreign Application Priority Data

Aug. 23, 1999 (JP) ..... 11-235521
Mar. 14, 2000 (JP) ..... 2000-070184

(51) Int. Cl.[7] ..... B65H 1/08

(52) U.S. Cl. ..... 271/147; 271/160; 271/162; 271/171

(58) Field of Search ..... 271/145, 147, 271/160, 162, 171

(56) References Cited

U.S. PATENT DOCUMENTS 4,569,587 A * 2/1986 Miyoshi et al. ..... 271/160
4,623,137 A * 11/1986 Irie et al. ..... 271/127
5,815,787 A 9/1998 Crayton et al.
6,039,315 A * 3/2000 Lim ..... 271/127
6,182,963 B1 * 2/2001 Yergenson ..... 271/160

* cited by examiner

*Primary Examiner*—David H. Bollinger
(74) *Attorney, Agent, or Firm*—Oliff & Berridge, PLC

(57) ABSTRACT

Each rear edge of an upper plate that receives a portion of a front edge side of a sheet is engaged with each slit provided to a sheet support member that receives a portion of a rear edge side of the sheet. Further, an end guide where the rear edge of the sheet contact is provided to the sheet support member. Therefore, the end guide moves back and forth in synchronization with a vertical swing of the upper plate. Even though the upper plate is vertically swung, a distance between a front edge of the upper plate and the end guide is maintained at substantially the same distance. Consequently, a deviation of the sheet caused by swinging only the upper plate can be prevented.

21 Claims, 11 Drawing Sheets

SHEET FEEDER

BACKGROUND OF THE INVENTION

1. Field of Invention

The invention relates to a sheet feeder that feeds sheets to an image forming apparatus.

2. Description of Related Art

A sheet feeder of this type is shown in FIG. 11 that includes a sheet pressing plate 101 on which a portion of a front edge side of sheet is stacked thereon, swing arms 102 that have supporting points at an upper portion of the sheet pressing plate 101 and vertically swing a front end of the sheet pressing plate 101, a spring 104 that upwardly urges the front end of the sheet pressing plate 101 against a sheet feed roller 103, and an end guide 105 that regulates rear edges of the sheets, has been known. In this sheet feeder, the front end of the sheet pressing plate 101 is upwardly swung by a pressing force from the spring 104, and the sheets are supplied one by one by rotating the sheet feed roller 103 in a state where the front edge of the uppermost sheet stacked on the sheet pressing plate 10 is pressed against the sheet feed roller 103.

In the sheet feeder, the supporting points of the swing arm 102 function as supporting points of swing of the sheet pressing plate 101. Therefore, a distance between a front edge of the sheet pressing plate 101 and the end guide 105 varies with the vertical swing of the sheet pressing plate 101. Consequently, sheets stacked on the sheet pressing plate 101 may be deviated.

Therefore, an initial proposal was to provide a sheet feeder that prevents the sheets from deviation. Such a sheet feeder is shown in FIG. 12 as a developmental prototype In the developmental sheet feeder, the end guide 105 is urged against the rear edges of the sheets by a spring 106, so that the rear edges of the sheets are pressed by the end guide 105 at all times.

However, the sheets are continuously applied the pressing force from the end guide 105 because the rear edges of the sheets are pressed by the end guide 105 at all times. Therefore, when the stack of sheets accommodated in the sheet feeder is few, the pressing force in this developmental sheet feeder was too strong. As a result, two or more sheets may be fed to the sheet feed roller 103 at a time. On the other hand, when the stack of sheets accommodated in the developmental sheet feeder is large, the pressing force was insufficient. As a result, no sheet may reach and may be fed to the sheet feed roller 103. Consequently, a stable sheet feeding may not be performed as described above.

SUMMARY OF THE INVENTION

According to the invention, a sheet feeder that surely and stably feeds sheets to an image forming apparatus, with a simple structure, can be obtained.

In the sheet feeder, a stacking portion where sheets are stacked thereof is swingable vertically, and an end guide where rear edges of the sheets contact moves back and forth in accordance with the vertical swing of the stacking portion. The stacking portion is swung vertically in accordance with a consumption of sheets stacked on the stacking portion.

The stacking portion where the sheets are stacked swings vertically while a distance between the stacking portion and the end guide is maintained at the same distance. Therefore, the sheets stacked on the stacking portion do not move back and forth, so that the sheets are reliably fed one by one at a time, without being fed two or more at a time or failing to be fed.

The end guide is provided on a support portion that supports the rear portions of the sheets. Further, a slit provided to the support portion and a bent portion provided to the stacking portion are engaged with each other. Because the bent portion engages the slit, the support portion moves back and forth when the stacking portion swings vertically. Therefore, the sheet itself can hardly receive the slide resistance due to the back and forth movement, so that the sheet feeding becomes more stable.

If a surface shape of the end guide where the rear edges of the sheets contact is formed such that a middle portion in its vertical direction is curved backward, the front edge of the uppermost sheet stacked on the stacking portion can be positioned at an optimum position where the sheet is always fed regardless of the stacking condition of the sheets, that is, regardless of a swing angle of the stacking portion.

Particularly, in order to distinguish this advantage, the surface shape of the end guide is preferably determined so that the position of the rear edge of the uppermost sheet stacked on the stacking portion always satisfies an equation shown below.

$$L+(R1\tan(b+\theta)-R1\tan\theta)+(0\text{–}5\text{ mm})$$

(when the rear edge of the stacking portion is positioned ahead of the normal dropping from the center of rotation of the stacking portion)

or $$L+(R1\tan\theta-R1\tan(\theta-b))+(0\text{–}5\text{ mm})$$

(when the rear edge of the stacking portion is positioned behind of the normal dropping from the center of rotation of the stacking portion)

where:

L: a length of the horizontal component of the uppermost sheet to be stacked on the stacking portion;

R1: a length of a line segment of a normal dropping from a center of swing of the stacking portion to the support portion;

b: a swing angle of the stacking portion from a reference angle θ; and

θ: an angle formed between the normal dropping from the center of swing of the stacking portion to the support portion and a line segment that connects the center of swing of the stacking portion and the rear edge of the stacking portion when the sheets are fully stacked.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Figure 1:
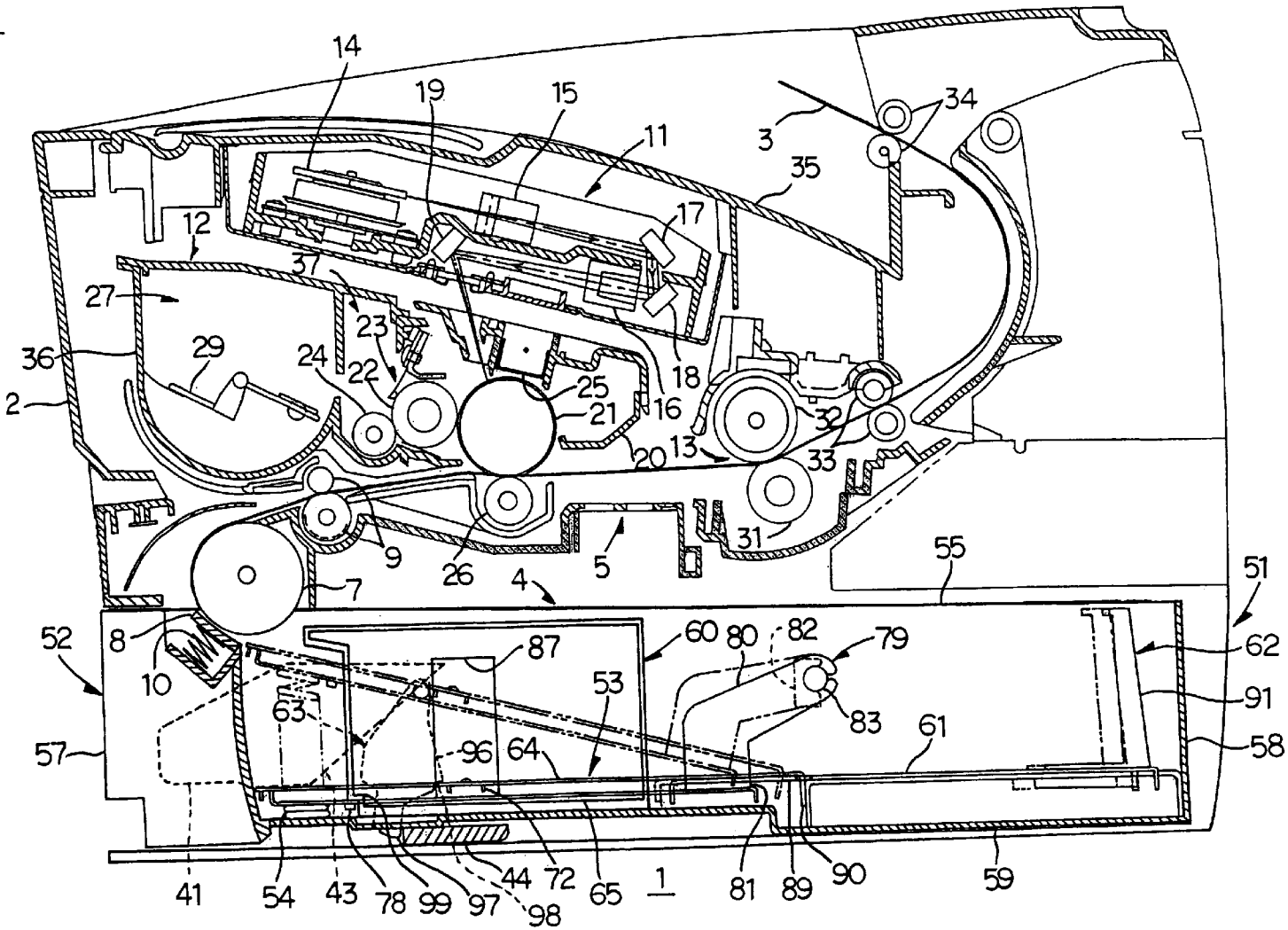
FIG. 1 is a side sectional view of essential parts of a laser printer.

FIG. 1 is a side sectional view of essential parts showing an embodiment of a laser printer provided with a sheet feeder of the invention. Although described in use with a laser printer, the invention can be used with any printer that prints on sheets, such as an ink jet printer or a dot matrix printer.

In FIG. 1, a laser printer 1 includes a feeder unit 4, an image forming unit 5 for forming a predetermined image on a sheet 3 fed from the feeder unit 4, and the like, in a main casing 2.

The feeder unit 4 includes a sheet cassette housing portion 51 formed at a bottom of the main casing 2, a sheet cassette 52 detachably attached to the sheet cassette housing portion 51, a sheet feed roller 7 disposed above one end of the sheet cassette 52, and resist rollers 9 disposed downstream of a feed direction of the sheet 3 with respect to the sheet feed roller 7.

As described later, the sheet cassette 52 includes a sheet pressing plate 53 where the sheets 3 are stacked thereon, springs 54, a separation pad 8, and a spring 10 that urges the separation pad 8. The springs 54 upwardly urge a front end portion of the sheet pressing plate 53, more particularly, the end portion of the sheet pressing plate 53 near the sheet feed roller 7, from the reverse side of the sheet pressing plate 53. The separation pad 8 and the spring 10 are illustrated in only FIG. 1, in other words, they are omitted in FIGS. 2 trough 9.

An uppermost sheet 3 in the stack on the sheet pressing plate 53 is pressed against the sheet feed roller 7 by the urging force from the springs 54, from the reverse side of the sheet pressing plate 53. As the sheet feed roller 7 rotates, the sheet 3 is pinched between the sheet feed roller 7 and the separation pad 8. The sheets 3 are fed in one sheet at a time. The resist rollers 9 include a drive roller and a driven roller. The resist rollers 9 temporarily stop the sheet 3 fed from the sheet feed roller 7 to adjust a deviation of the sheet 3 and then feed the sheet 3 to the image forming unit 5.

The image forming unit 5 includes a scanning unit 11, a developing unit 12, and a fixing unit 13.

The scanning unit 11 is provided in an upper portion of an internal space of the main casing 2. The scanning unit 11 has a laser emitting portion (not shown), a rotatable polygon mirror 14, lenses 15, 16, and reflecting mirrors 17, 18, 19. A laser beam that is emitted from the laser emitting portion based on predetermined image data sequentially passes through or is reflected by the polygon mirror 14, the lens 15, the reflecting mirrors 17, 18, the lens 16, and the reflecting mirror 19 in that order as indicated by a dot and dashed line. The laser beam is thus directed to and high-speed scanned over a photoconductive drum 21 of the developing unit 12 for irradiation of the surface of the photoconductive drum 21.

The developing unit 12 is disposed below the scanning unit 11. The developing unit 12 includes the photoconductive drum 21, a developing cartridge 36, a scorotron electrical charging device 25, and a transfer roller 26 in a drum cartridge 20 that is detachably attached to the main casing 2.

An internal space of the developing cartridge 36 is divided into a developing chamber 37 that contains the developing roller 22, a layer thickness-regulating blade 23, and a supply roller 24, and into a toner box 27 containing toner. The toner box 27 contains positively electrically charged toner of a single non-magnetic component. The toner is agitated by an agitator 29 provided at a center of the toner box 27, and is discharged into the developing chamber 37. In the developing chamber 37, the supply roller 24 is rotatably disposed at the toner box 27 side. The developing roller 22 is rotatably disposed facing the supply roller 24. The supply roller 24 and the developing roller 22 are disposed in contact with each other so that they are press-deformed against each other to an appropriate extent. The supply roller 24 is formed by covering a metallic roller shaft with a roller part formed from an electrically conductive foam material. The developing roller 22 is formed by covering a metallic roller shaft with a roller part formed by an electrically conductive rubber material. The developing roller 22 is applied a bias so as to produce an electric potential difference between the developing roller 22 and the photoconductive drum 21. The layer thickness-regulating blade 23 that regulates a thickness of toner on the developing roller 22 is disposed near the developing roller 22.

Toner discharged from the toner box 27 into the developing chamber 37 is supplied to the developing roller 22 as the supply roller 24 rotates. At this time, toner is positively electrically charged between the supply roller 24 and the developing roller 22 due to friction. After being supplied onto the developing roller 22, toner enters a gap between the layer thickness-regulating blade 23 and the developing roller 22 as the developing roller 22 rotates. Toner becomes sufficiently electrically charged therebetween due to friction, and is formed into a thin layer of a predetermined thickness on the developing roller 22.

The photoconductive drum 21 is rotatably disposed beside the developing roller 22 so that the photoconductive drum 21 faces the developing roller 22. A drum body of the photoconductive drum 21 is grounded, and its surface is formed from a positively electrically charged organic photoconductive material containing a polycarbonate as a main component. The scorotron electrical charging device 25 is disposed at a predetermined interval upward from the photoconductive drum 21. The scorotron electrical charging device 25 produces corona discharge from a tungsten wire and positively charges the surface of the photoconductive drum 21 uniformly.

After the surface of the photoconductive drum 21 is uniformly positively charged by the scorotron electrical charging device 25, the surface of the photoconductive drum 21 is exposed to a laser beam emitted from the scanning unit 11 so that an electrostatic latent image is formed based on predetermined image data. The electrostatic latent image comprises portions of the uniformly positively charged surface of the photoconductive drum 21 that have a reduced electric potential due to exposure to the laser beam. When positively charged toner carried on the developing roller 22 comes to face and contact the photoconductive drum 21 as the developing roller 22 rotates, the toner is selectively transferred and deposited onto the electrostatic latent image formed on the surface of the photoconductive drum 21, so that the image is visualized. Thus, image development (reversal development) is accomplished.

The transfer roller 26 is rotatably disposed and opposing the photoconductive drum 21. The transfer roller 26 is formed by covering a metallic roller shaft with a roller part formed from an electrically conductive rubber material. A predetermined transfer bias is applied to the transfer roller 26. Therefore, the toner image developed on the photoconductive drum 21 is transferred to the sheet 3 due to the transfer bias when the sheet 3 is passed between the photoconductive drum 21 and the transfer roller 26.

The fixing unit 13 is disposed beside the developing unit 12, that is downstream thereof, as shown in FIG. 1. The fixing unit 13 includes a heat roller 32, a pressing roller 31 pressed against the heat roller 32, and a pair of conveying rollers 33 disposed downstream of the heat roller 32 and the pressing roller 31. The heat roller 32 is a hollow-roller made from metal and is equipped with a heating halogen lamp. While the sheet 3 is being passed between the heat roller 32 and the pressing roller 31, toner transferred on the sheet 3 melts and becomes fixed due to heat. Then, the sheet 3 is conveyed to a pair of sheet ejecting rollers 34 by the conveying rollers 33. The sheet 3 is then ejected onto an output tray 35 by the sheet ejecting rollers 33.

The sheet cassette 52 is structured as described below.

Figure 2:
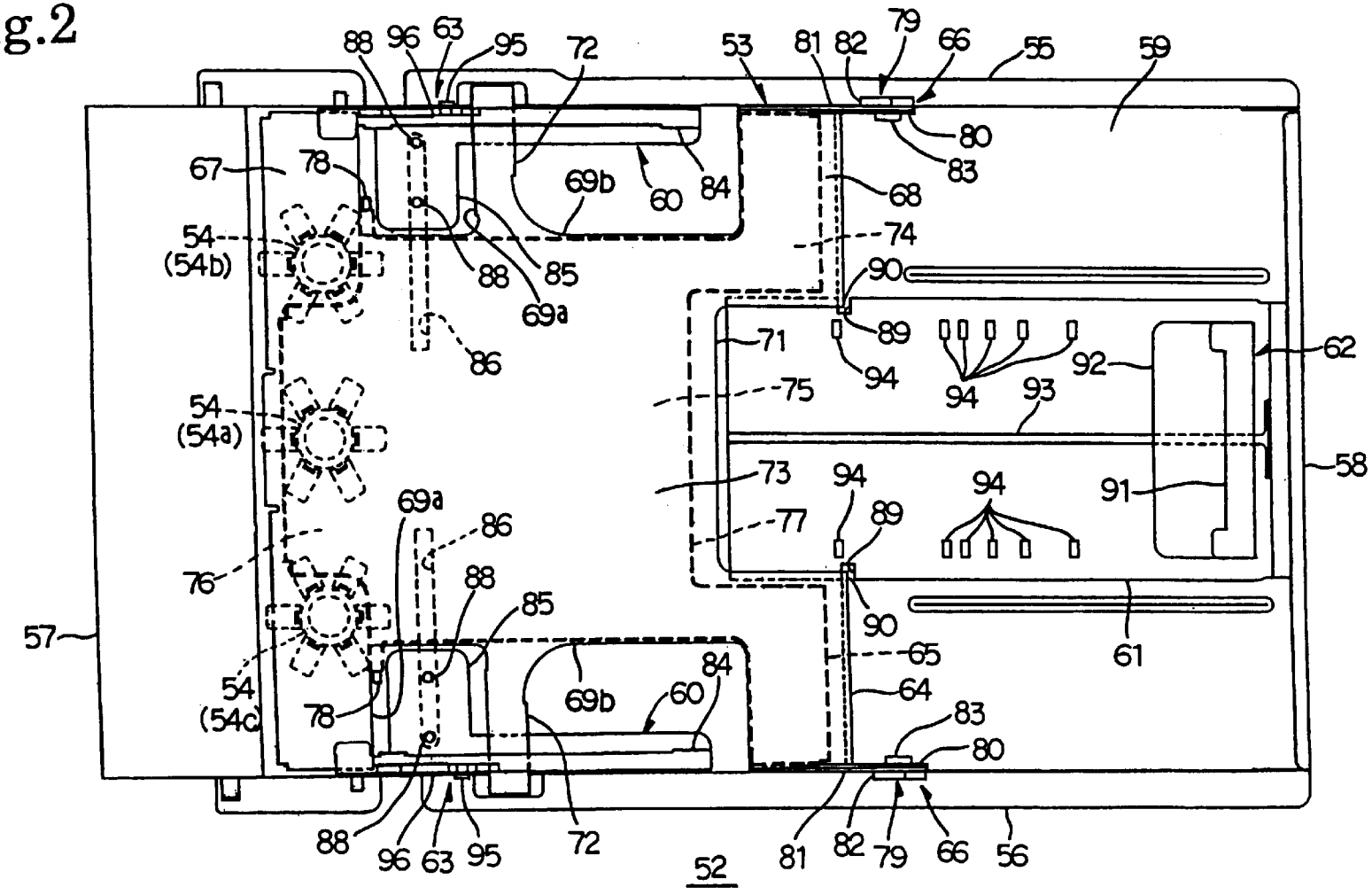
FIG. 2 is a plan view of essential parts of a sheet cassette provided in the laser printer of FIG. 1.
Figure 3:
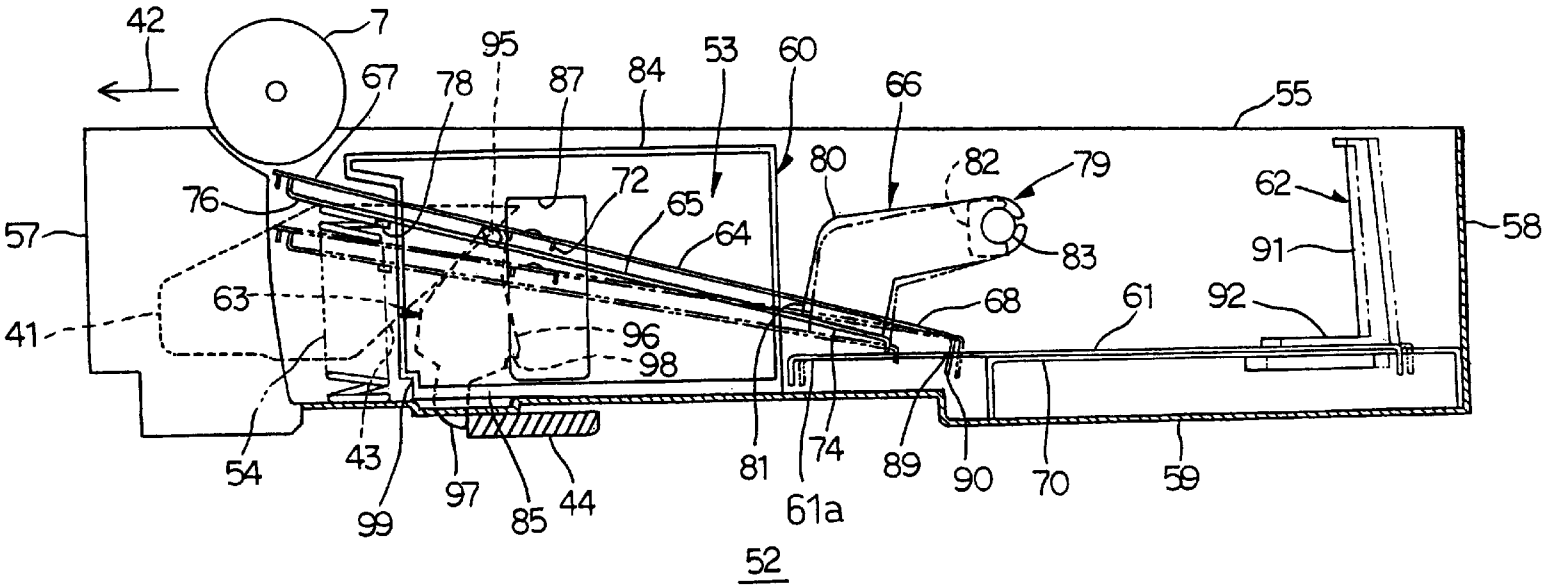
FIG. 3 is a side sectional view of essential parts showing the sheet cassette of FIG. 2 when the stack of sheets in the sheet cassette is a minimum.

As shown in FIGS. 2 and 3, the sheet cassette 52 is a generally rectangular box shape having an upper open structure. The sheet cassette 52 is formed with side plates 55, 56 disposed on both sides of the sheet cassette 52 in a width direction so as to face each other, a grip portion 57 provided at the front end in a feed direction of the sheet 3, a rear plate 58 provided at the rear end, and a bottom plate 59.

As described above, in the sheet cassette 52, the sheet pressing plate 53, the springs 54, side guides 60, a sheet support member 61, an end guide 62, and upper plate holding members 63 are provided.

The sheet pressing plate 53 includes an upper plate 64 receiving the portion of the front edge side of the sheet 3, a lower plate 65, and swing arms 66 as a swing member.

A front end 67 and a rear end 68 of the upper plate 64 extend in both directions of the width direction of the sheet cassette 52. A middle portion 73 of the upper plate 64 is narrower than the front and rear ends 67, 68 and has a generally rectangular shape. Engagement plates 72 having a generally rectangular shape outwardly protrude from each side edge of the middle portion 73 in the width direction, between the front and rear ends 67, 68, as a second engagement portion. Generally rectangular side openings 69*a*, 69*b* (together called side opening 69) are defined at each side of the upper plate 64. The side opening 69*a* is inwardly concaved and is defined by a rear edge of the front end 67, a side edge of the middle portion 73, and a front edge of the engagement plate 72. The side opening 69*b* is also inwardly concaved and is defined by a rear edge of the engagement plate 72, the side edge of the middle portion 73, and a front edge of the rear end 68. A rear opening 71 is concavely formed at the rear end 68 toward the front from the rear edge of the rear end 68.

The bottom plate 65 is disposed below the upper plate 64 so as to overlap each other. A rear end 74 of the lower plate 65 extends in both directions in the width direction of the sheet cassette 52. A middle portion 75 of the lower plate 65 is narrower than the rear end 74 and has a generally rectangular shape. The shape of the middle portion 75 of the lower plate 65 is substantially the same as that of the middle portion 73 of the upper plate 64.

Further, a front end 76 of the lower plate 65 is further narrower than the middle portion 75 and has a generally rectangular shape. A rear opening 77 is concavely formed at the rear end 74 toward the front from the rear edge of the rear end 74 and has a generally rectangular shape (which is slightly larger than the rear opening 71 of the upper plate 64). Engagement protrusions 78 outwardly protrude from each side edge of the front end of the middle portion 75 in the width direction.

The swing arm 66 including an arm holder 79, comprised of holder member 82 and swing shaft 83, is provided at each side plate 55, 56 of the sheet cassette 52. Upper plate arms 80 and lower plate arms 81 are supported by arm holders 79 so that the upper and lower plate arms 80, 81 can be freely swung vertically. Each arm holder 79 has the holder member 82 provided at an upper portion near the rear ends 68, 74 of the upper and lower plates 64, 65, and the swing shaft 83 supported by the holder member 82. Each upper plate arm 80 has a generally V-shape. One end of each upper plate arm 80 is supported by the swing shaft 83 so that the upper plate arm 80 can be vertically swung and another end is connected to each side edge of the rear end 68 of the upper plate 64. Similarly, each lower plate arm 81 has a generally V-shape. One end of each lower plate arm 81 is supported by the swing shaft 83 so that the lower plate arm 81 can be vertically swung and another end is connected to each side edge of the rear end 74 of the lower plate 65.

Therefore, the upper plate 64 is supported by the swing shafts 83 via the upper plate arms 80 so that the upper plate 64 can be swung. The front end 67 of the upper plate 64 can be swung vertically about the swing shafts 83 provided at a position higher than the upper plate 64. Similarly, the lower plate 65 is supported by the swing shafts 83 via the lower plate arms 81 so that the lower plate 65 can be swung. The front end 76 of the lower plate 65 can be swung vertically about the swing shafts 83 provided at a position higher than lower plate 65.

Three springs 54 are provided on the bottom plate 59 of the sheet cassette 52 along the width direction of a front end of the bottom plate 59. The center spring 54*a* is disposed facing the reverse surface of the front end 76 of the lower plate 65. The springs 54*b*, 54*c* disposed on both sides of the center spring 54*a* are disposed facing the reverse surface of the front end 67 of the upper plate 64. Therefore, the front end 67 of the upper plate 64 is urged against the sheet feed roller 7 by the springs 54*b*, 54*c* and the front end 76 of the lower plate 65 is urged against the sheet feed roller 7 by the spring 54*a*. Consequently, the upper plate 64 urged by the springs 54*b*, 54*c* is further pressed by the lower plate 65 urged by the spring 54*a*.

The side guides 60 are provided at both sides in the width direction of the sheet pressing plate 53, facing each side opening 69 of the upper plate 64. Each side guide 60 includes a generally rectangular side edge contact member 84 for contacting the side edge in the width direction of the sheet 3 and a side edge slide member 85 supporting the side edge contact member 84. A rectangular opening 87 where the engagement plates 72 of the upper plate 64 can be passed therethrough is formed in a center portion of each side edge contact member 84. Engagement stepped portions 99 that engage engagement protrusions 78 provided to the lower plate 65 are provided at the front lower end of the side guides 60. Each side edge slide member 85 is provided with protrusions 88 at its reverse surface. The bottom plate 59 is provided with side guide guiding grooves 86 for guiding the side guides 60 to position in accordance with the size of the sheet 3 along the width direction. Each side guide guiding groove 86 is formed along the width direction of the sheet cassette 52 at the position opposed to the side edge slide member 85 of each side guide 60.

Figure 6:
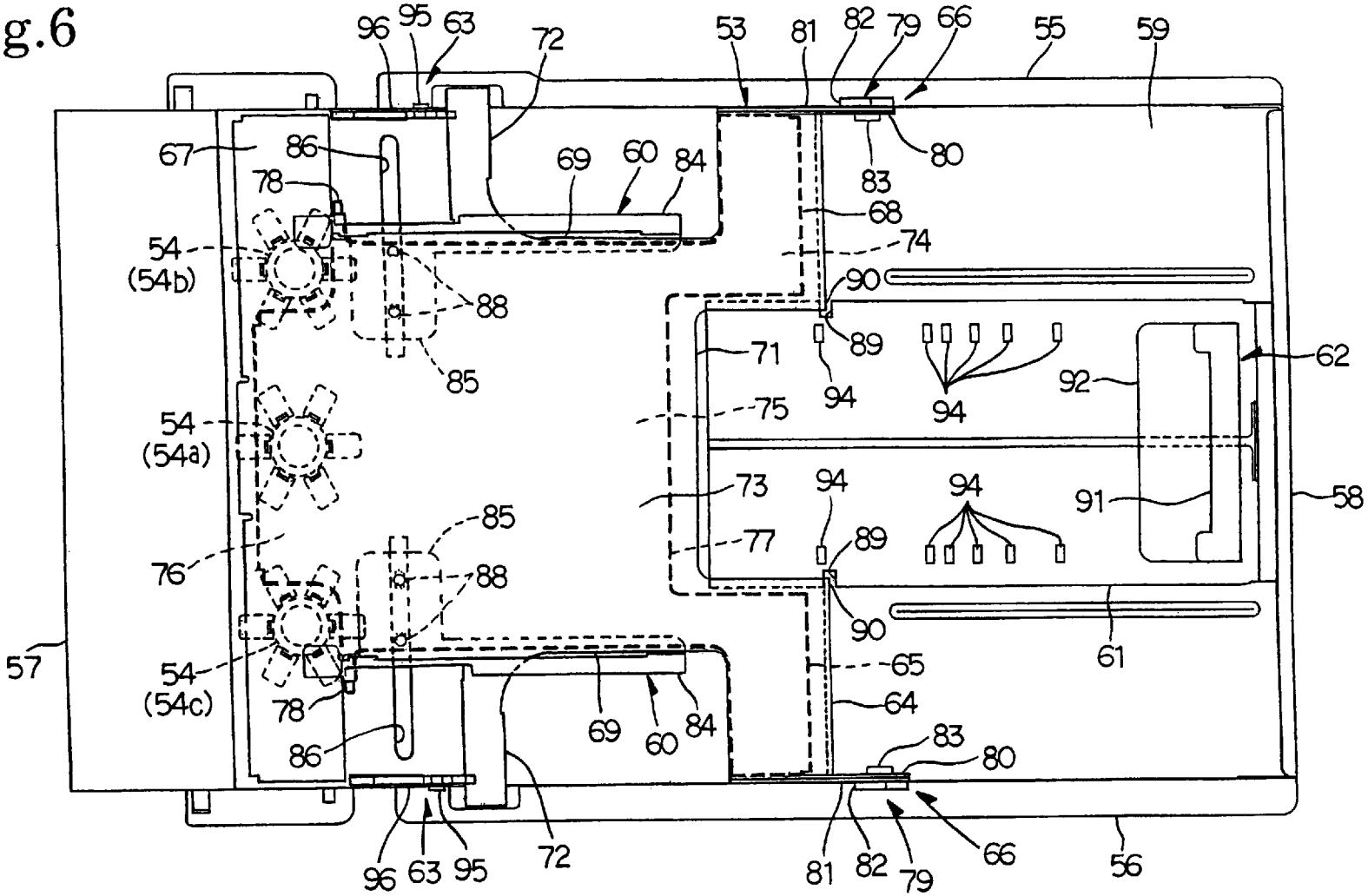
FIG. 6 is a plan view of essential parts showing the sheet cassette of FIG. 2 when side guides thereof are slid inward in a width direction of the sheet cassette.

The protrusions 88 of each side edge slide member 85 are engaged with each side guide guiding groove 86. Therefore, each side guide 60 can be slid outward (a first direction) or inward (a second direction) in the width direction along each side guide guiding groove 86. Accordingly, when large sized sheets 3, e.g. A3-size sheets, are stacked in the sheet cassette 52, the side guides 60 are slid outward in the width direction so as to regulate side edges of the sheets 3. On the other hand, when small sized sheets 3, e.g., A4- or B5-size sheets, are stacked in the sheet cassette 52, the side guides 60 are slid inward in the width direction so as to regulate side edges of the sheets 3. When the side guides 60 are slid inward in the width direction, as shown in FIG. 6, the slide guides 60 are slid in each side opening 69 (combined side openings 69*a*, 69*b* ) of the upper plate 64 and each engagement plate 72 of the upper plate 64 is inserted into the opening 87 in each of the side contact members 84.

The sheet support member 61 that has a generally rectangular shape and receives the portion of the rear edge side of the sheet 3 stacked thereof is provided on the rear side of the sheet pressing plate 53. A generally C-shaped sheet support member guide plate 70 for guiding the sheet support member 61 back and forth is provided facing the reverse surface of the sheet support member 61 on the bottom plate 59. The sheet support member 61 is slidably disposed so as to be able to move back and forth along the guide plate 70. A front end 61*a* of the sheet support member 61 is disposed under the rear openings 71, 77 of the upper and lower plates 64, 65. Slits 89 which are inwardly concaved are formed at both sides of the front end 61*a* in the width direction. A rear edge 90 of the rear end 68 of the upper plate 64 is formed in an L-shape in section by bending downward. The rear edge 90 is engaged with each slit 89. Each slit 89 and each rear edge 90 are a link device and an engagement device of the invention, respectively.

As the rear edge 90 is engaged with the slits 89, the sheet support member 61 moves back and forth in synchronization with the vertical swing of the upper plate 64.

The end guide 62 is disposed on the sheet support member 61. The end guide 62 includes a rear edge contact member 91 for contacting the rear edge of the sheet 3 and a rear edge slide member 92 for supporting the rear edge contact member 91. The rear edge contact member 91 has a generally rectangular shape and stands on the rear edge slide member 92. An end guide guiding groove 93 for guiding the end guide 62 back and forth to position in accordance with the size of the sheet 3 is provided at the position opposed to the rear edge slide member 92 of the end guide 62. Further, a plurality of stopper grooves 94 are formed in the sheet support member 61 to set the end guide 62 at a position corresponding to various standardized sizes.

The rear edge slide member 92 is engaged with the end guide guiding groove 93, so that the end guide 62 can be slid back and forth along the end guide guiding groove 93. In this state, the rear edge slide member 92 is engaged with the stopper grooves 94 to regulate the rear edge of the sheet 3 at a position according to a predetermined standard.

The upper plate holding members 63 are disposed near the front of each engagement plate 72 of the upper plate 64 in the side plates 55, 56 of the sheet cassette 52. Each upper plate holding member 63 has a shaft 95 and a pawl member 96 that is provided to the shaft 95 so as to be swingable. The pawl member 96 has a generally triangular shape. A contact protrusion 97 that protrudes downwardly and a stepped portion 98 that is formed in a hook shape at a corner are formed at a lower portion of the pawl member 96. The pawl member 96 can be swung between a position where the stepped portion 98 engages the engagement plate 72 and a position where the contact protrusion 97 contacts a contact member 44 (described later) about the shaft 95.

The sheet cassette housing portion 51 which is formed in the main casing 2 and has the sheet cassette 52 detachably mounted therein, is provided with generally rhombic shaped guide members 41 that guide the engagement plates 72 of the upper plate 64 to the engaging position with the pawl member 96 at both sides of the front end side of the sheet cassette 52. An inclined surface 43 is formed on each guide member 41. When the sheet cassette 52 is pulled out in an arrow 42 direction to be removed from the sheet cassette housing portion 51, each inclined surface 43 makes contact with an engagement plate 72 of the upper plate 64 and guides the contacting engagement plate 72 downward.

In the sheet cassette housing portion 51, the contact members 44 having a rectangular shape in section are provided below the pawl members 96 at both sides of the front end side of the sheet cassette 52. When the sheet cassette 52 is mounted in the sheet cassette housing portion 51, the contact protrusion 97 of the pawl member 96 contacts the contact member 44.

A case where small sized sheets 3, e.g., letters, B5- or A4-size sheets, are fed from the sheet cassette 52 structured as described above will be described.

Figure 4:
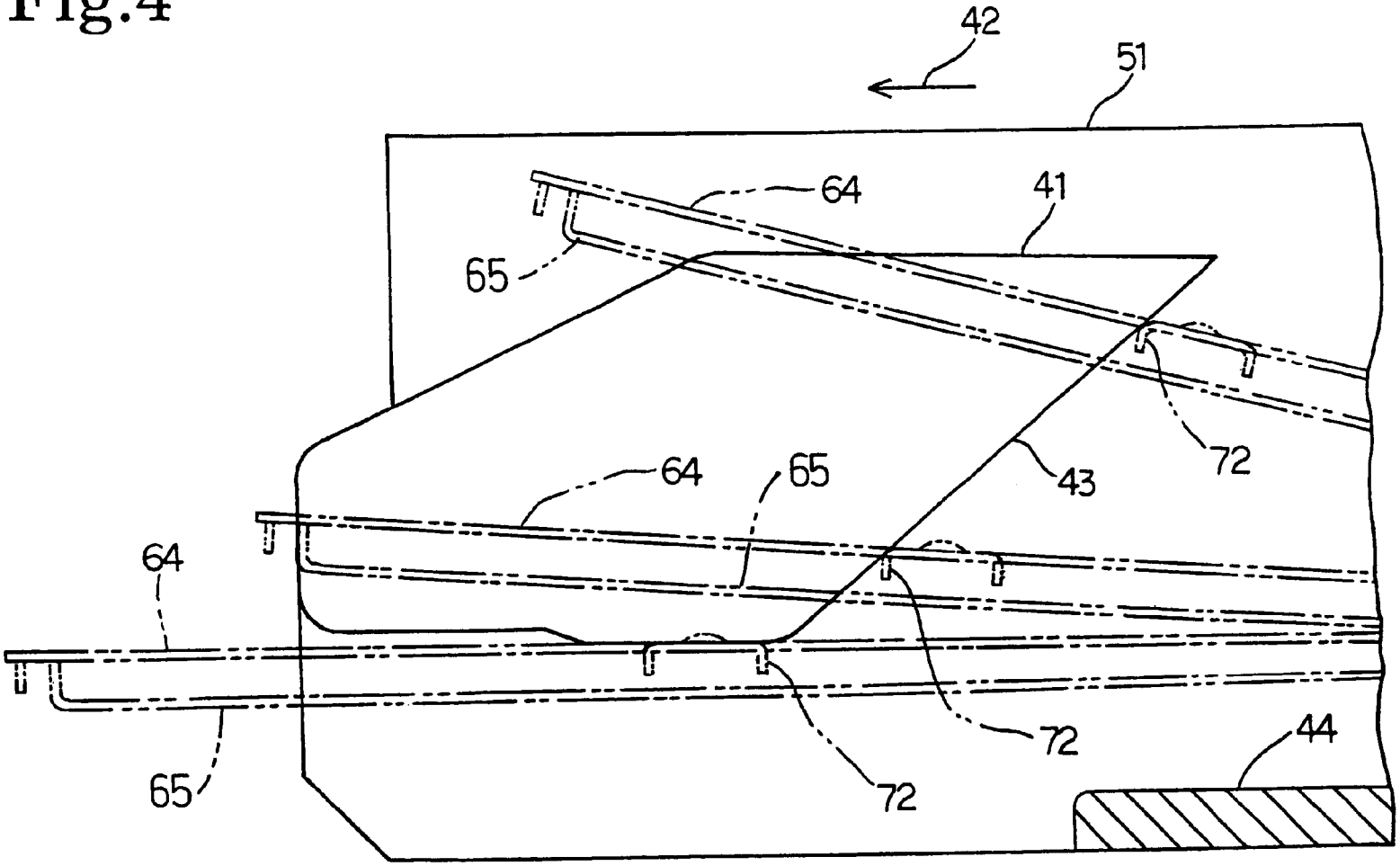
FIG. 4 is a side sectional view of essential parts showing the process of pulling the sheet cassette of FIG. 2 from a sheet cassette housing portion.

As shown in FIG. 3, the sheet cassette 52 is pulled out from the sheet cassette housing portion 51 in the arrow 42 direction in a state where sheets 3 on the upper plate 64 run out. When the sheet cassette 52 is pulled out in the arrow 42 direction, each engagement plate 72 of the upper plate 64 contacts the inclined surface 43 of a guide member 41 and the engagement plate 72 is guided downward along the inclined surface 43, as shown in FIG. 4. Therefore, the front end 67 of the upper plate 64 is swung downward against the urging force from the springs 54 while the upper plate 64 presses the front end 76 of the lower plate 65.

When the sheet cassette 52 is completely pulled out from the sheet cassette housing portion 51, the stepped portion 98 of the pawl member 96 engages the engagement plate 72 that is moved down to the lowermost position, under its own weight. The upper and lower plates 64, 65 are held at the lowermost position with the urging force from the springs 54 being regulated. Small sized sheets 3, e.g., letter-, B5- or A4-size sheets, are stacked on the upper plate 64, and then the side guides 60 are slid inward in the width direction in accordance with the sheets 3, as shown in FIG. 6.

Then, as shown in FIG. 6, the engagement stepped portions 99 of the side guides 69 engage the engagement protrusions 78 of the lower plate 65. Further, the end guide 62 is slid in accordance with the size of the sheets 3. After that, the sheet cassette 52 is inserted into the sheet cassette housing portion 51.

Figure 7:
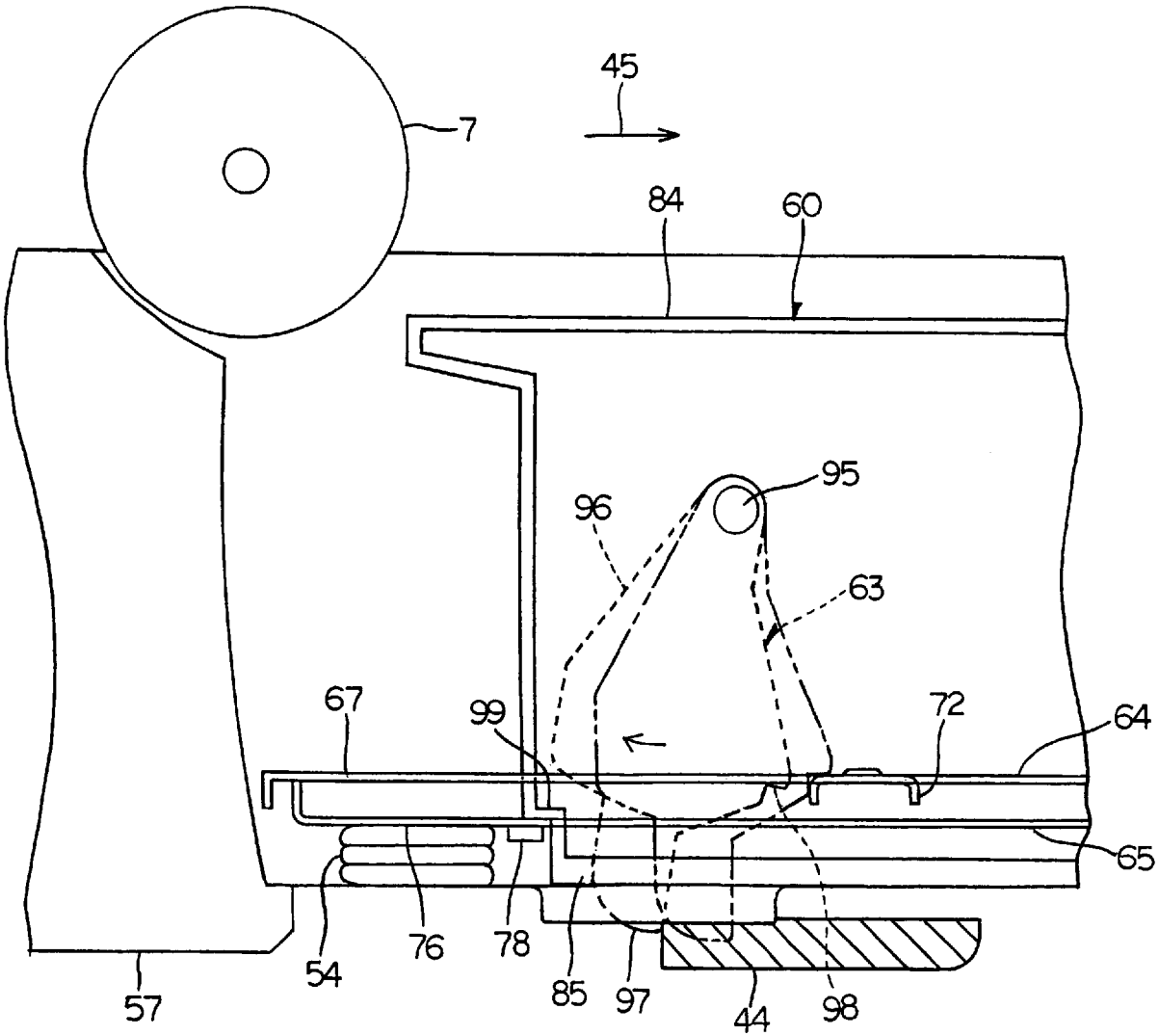
FIG. 7 is a side sectional view showing a process of inserting the sheet cassette of FIG. 2 into the sheet cassette housing portion.

When the sheet cassette 51 is inserted in an arrow 45 direction, the contact protrusions 97 of the pawl members 96 contact the contact members 44 of the sheet cassette housing portion 51, as shown in FIG. 7. Each pawl member 96 is swung upward about the shaft 95, and thus the stepped portion 98 of the pawl member 96 is disengaged from the engagement plate 72. Therefore, when the sheet cassette 52 is completely inserted, the lower plate 65 is held at the lowermost position with the urging force from the spring 54*a* being regulated by the engagement of the engagement protrusions 78 and engagement stepped portions 99 of the side guides 60. On the other hand, the front end 67 of the upper plate 64 is urged upward by the springs 54*b*, 54*c* because the engagement plates 72 are disengaged from the stepped portions 98 of the pawl members 96. That is, the front end 67 of the upper plate 64 is swung upward as the stack of sheets 3 on the upper plate 64 becomes few.

Therefore, when small sized sheets 3 are fed from the sheet cassette 52 of the embodiment, the lower plate 65 is held at the lowermost position against the urging force from the spring 54*a*, so that the lower plate 65 does not press the upper plate 64. That is, the small sized sheets 3 accommodated in the sheet cassette 52 are pressed upward by only the upper plate 64 urged by the urging force from the springs 54*b*, 54*c*.

Next, a case where large sized sheets 3, e.g., B4- or A3-size sheets, are fed from the sheet cassette 52 will be described.

Figure 5:
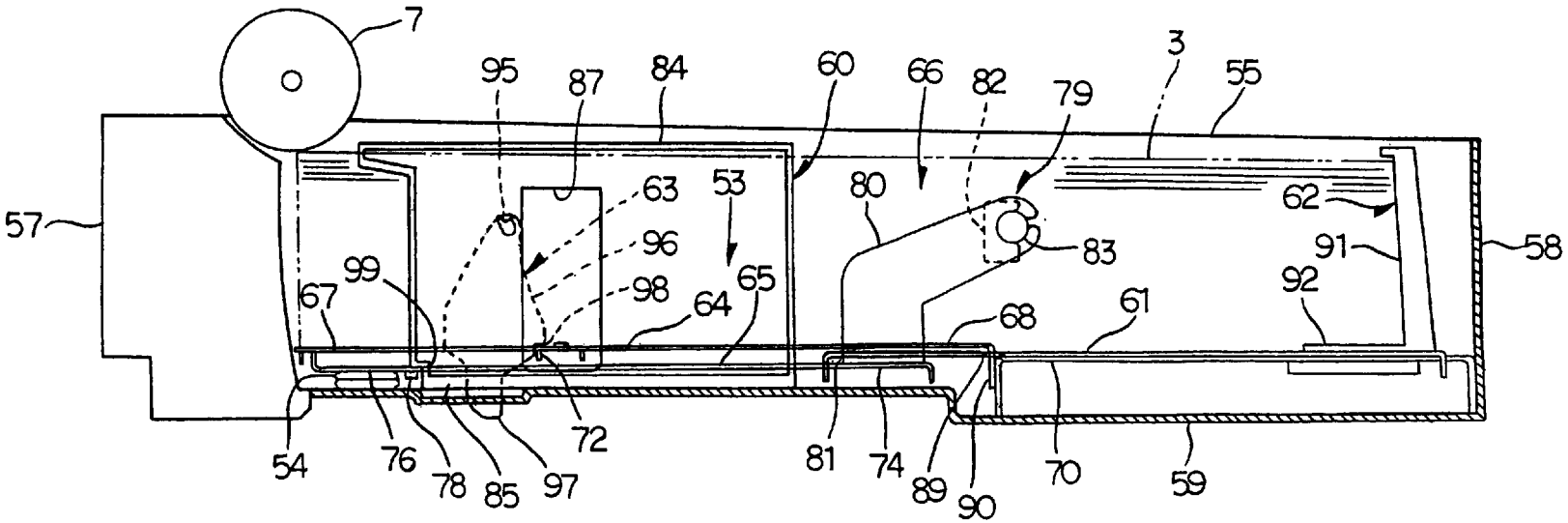
FIG. 5 is a side sectional view of essential parts showing the sheet cassette of FIG. 2 pulled from the sheet cassette housing portion.
Figure 8:
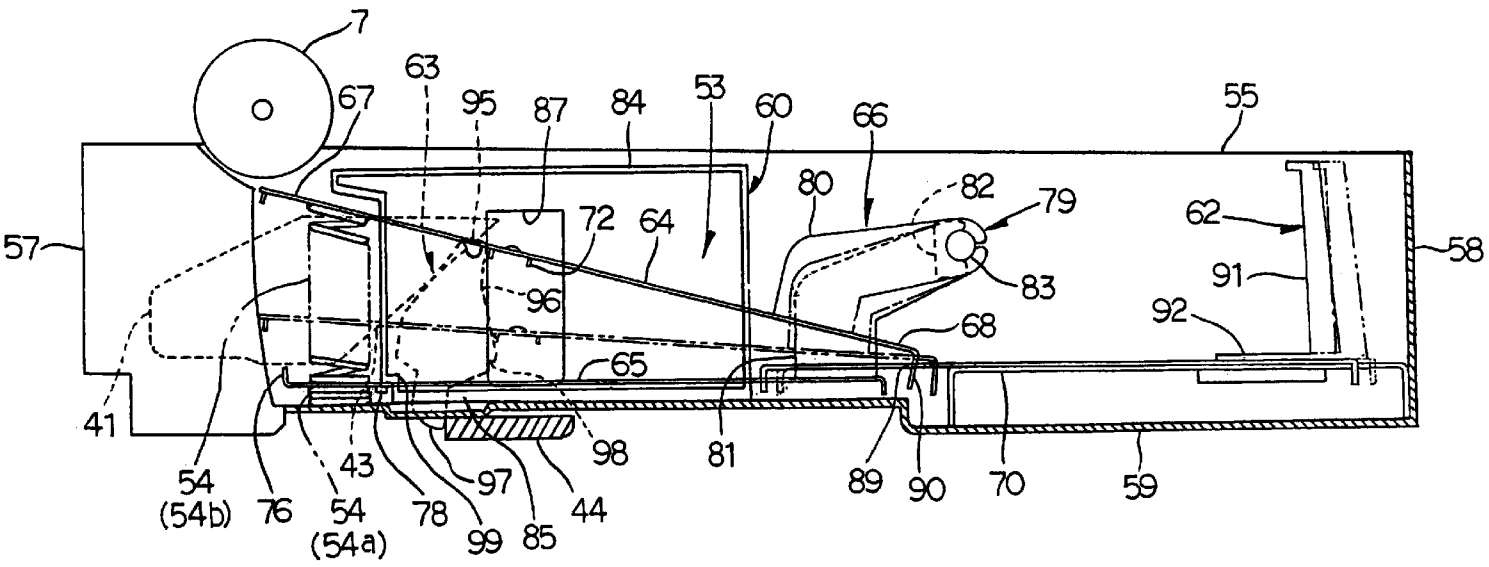
FIG. 8 is a side sectional view of essential parts showing a process of swinging only an upper plate in the sheet cassette of FIG. 2.

First, as shown in FIG. 8, the sheet cassette 52 is pulled out from the sheet cassette housing portion 51 in a state where the sheets 3 on the upper plate 64 run out. When the sheet cassette 52 is completely pulled out, the stepped portion 98 of each pawl member 96 engages a corresponding engagement plate 72 that is moved down to the lowermost position, and the upper and lower plates 64, 65 are held at the lowermost position, as shown in FIG. 5. This mechanism is as described above.

Then, the large sized sheets 3 are stacked on the upper plate 64 and each side guide 60 is slid outward in the width direction in accordance with the size of the sheets 3, as shown in FIG. 2. As a result, as shown in FIG. 2, the engagement stepped portion 99 of each side guide 60 is disengaged from the engagement protrusion 78 of the lower plate 65. The end guide 62 is also slid in accordance with the size of the sheets 3.

After the large sized sheets 3 are stacked on the upper plate 64, the sheet cassette 52 is inserted into the sheet cassette housing portion 51. Then, as described above, the stepped portions 98 of the pawl members 96 are disengaged from the engagement plates 72. When the sheet cassette 52 is completely inserted, the regulation of the urging of the springs 54 is released, so that the upper plate 64 is urged by the springs 54*b*, 54*c* and the lower plate 65 is urged by the spring 54*a*. As a result, the upper plate 64 is urged upward by further pressing by the lower plate 65. As the stack of sheets 3 on the upper plate 64 is decreased in quantity, the front end 67 of the upper plate 64 and the front end 68 of the lower plate 68 are swung upward.

Therefore, when the large sized sheets 3 are fed using the sheet cassette 52, the upper plate 64 is further pressed by the lower plate 65, so that the sheets 3 are pressed by the upper and lower plates 64, 65 that are urged by the urging force from the springs 54*a*, 54*b*, 54*c*.

As described above, in the sheet cassette 52 of the embodiment, when large sized sheets 3 are stacked on the upper plate 64, the lower plate 65 presses the upper plate 64 by the urging force from the spring 54*a* as each side guide 60 is slid outward in the width direction of the sheet cassette 52 and the engagement stepped portions 99 of the side guides 60 are disengaged from the engagement protrusions 78 of the lower plate 65. Therefore, the large sized sheets 3 are pressed by the pressing force from the lower plate 65 in addition to the pressing force from the upper plate 64. On the other hand, when small sized sheets 3 are stacked on the upper plate 64, the lower plate 65 does not press the upper plate 64 against the urging force from the spring 54*a* as each side guide 60 is slid inward in the width direction of the sheet cassette 52 and the engagement stepped portions 99 of the side guides 60 engage the engagement protrusions 78 of the lower plate 65. Therefore, the small sized sheets 3 are pressed only by the pressing force from the upper plate 64.

Accordingly, when the large sized sheets 3 are stacked on the upper plate 64, the sheets 3 are pressed against the sheet feed roller 7 by the large pressing force from the springs 54*a*, 54*b*, 55*c*. On the other hand, when the small sized sheets 3 are stacked on the upper plate 64, the sheets 3 are pressed against the sheet feed roller 7 by the small pressing force from the springs 54*b*, 54*c*. Consequently, an appropriate pressing force that corresponds to the size of the sheets 3 can be surely applied to the sheets 3 only by sliding the side guides 60 in the width direction of the sheet cassette 52 in accordance with the size of the sheets 3.

Further, the pressing force applied on the sheets 3 can be easily changed by a simple appropriate operation, such as the engagement or the disengagement of the engagement stepped portion 99 of the side guides 60 with the engagement protrusions 78 of the lower plate 65. As a result, the sheets 3 can be effectively prevented from being fed two or more at a time or from failing to be feed, so that the excellent feeding of the sheets 3 can be achieved.

Further, in the sheet cassette 52 of the invention, when the sheet cassette 52 is removed from the sheet cassette housing portion 51, the urging of the springs 54 is regulated to hold the lower plate 65 at a position where the engagement stepped portions 99 of the side guides 60 and the engagement protrusions 78 of the lower plate 65 can be engaged with and disengaged from each other, by engaging the pawl members 96 and the engagement plates 72 of the upper plate 64. Therefore, the engagement stepped portions 99 of the side guides 60 can be automatically engaged with or disengaged from the engagement protrusions 78 of the lower plate 65 only by sliding the side guides 60 in accordance with the size of the sheets 3. When the sheet cassette 52 is completely inserted in the sheet cassette housing portion 51, an appropriate pressing force can be applied to the sheet 3 by the urging force from the selected springs 54 because the pawl members 96 are disengaged from the engagement plates 72 of the upper plate 64. As the engagement and disengagement mechanism is structured using the pawl members 96, the upper plate 64, and the engagement plates 72, the urging of the springs 54 can be easily and surely regulated or released from regulation.

Furthermore, in the sheet cassette 52 of the invention, when the sheet cassette 52 is removed from the sheet cassette housing portion 51, each engagement plate 72 of the upper plate 64 is guided so that the inclined surface 43 of each guide member 41 engages the stepped portion 98 of each pawl member 96. Therefore, each engagement plate 72 of the upper plate 64 can be automatically engaged with the stepped portion 98 of the opposing pawl member 96. On the other hand, when the sheet cassette 52 is mounted in the sheet cassette housing portion 51, the contact protrusion 97 of the pawl member 96 contacts the contact member 44. Therefore, each engagement plate 72 of the upper plate 64 can be automatically disengaged from the stepped portion 98 of the pawl member 96.

Accordingly, when the sheet cassette 52 is mounted in the sheet cassette housing portion 51, an appropriate pressing force according to the size of the sheets 3 can be applied to the sheets 3 only by stacking predetermined sized sheets 3 on the upper plate 64 of the sheet cassette 52 removed from the sheet cassette housing portion 51 and sliding the side guides 60 in the width direction of the sheet cassette 52.

In the laser printer 1 including the sheet cassette 52 described above, the appropriate pressing force according to the size of the sheets 3 accommodated in the sheet cassette 52 is surely applied to the sheets 3 by the sheet cassette 52. Therefore, the laser printer 1 can be effectively prevented from a malfunction traceable to the size of the sheets 3, such that the sheets 3 are fed two or more at a time or fail to feed, so that the laser printer 1 can achieve an excellent image forming operation.

Figure 9:
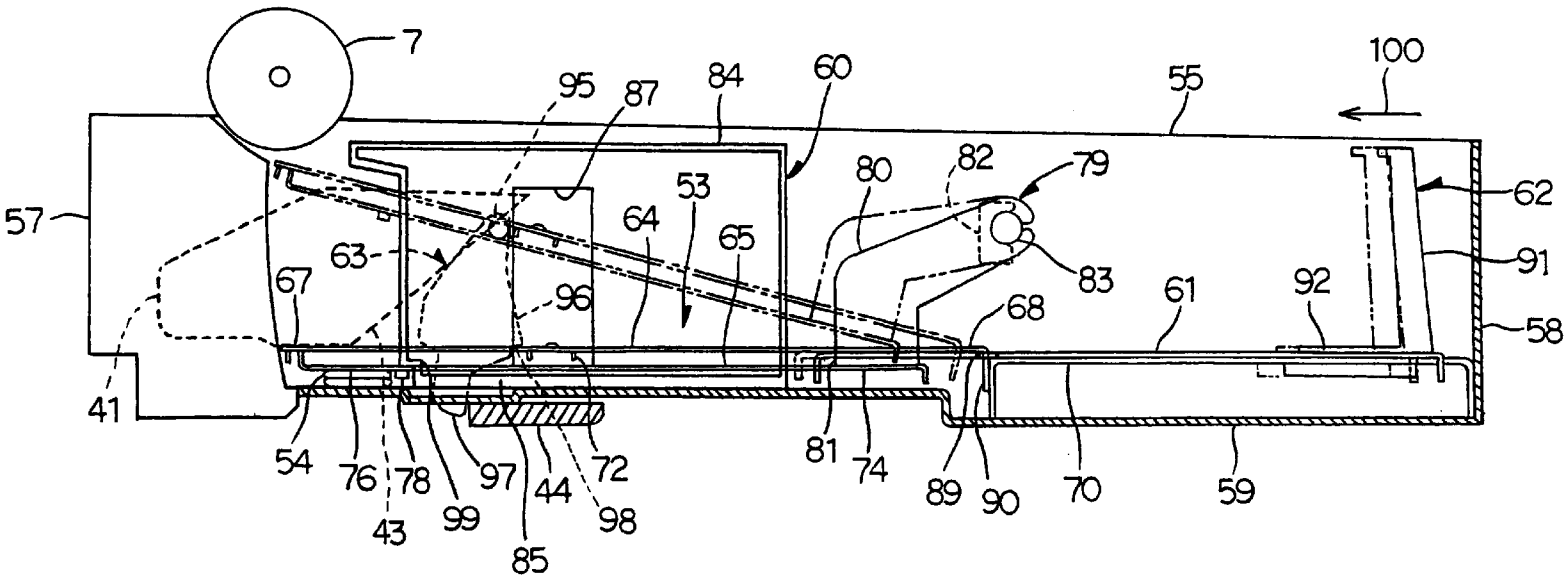
FIG. 9 is a side sectional view of essential parts showing movement of the end guide when the stack of sheets in the sheet cassette of FIG. 2 is a maximum and a minimum.

Further, in the sheet cassette 52 of the embodiment, as shown in FIG. 9, the front end 67 of the upper plate 64 is swung upward as the stack of sheets 3 on the upper plate 64 is decreased in quantity. At the time, the upper plate 64 moves forward. The rear edges 90 of the upper plate 64 are engaged with slits 89 of the sheet support member 61, so that the sheet support member 61 and the end guide 62 provided on the sheet support member 61 move forward as indicated by an arrow 100 in synchronization with the upward swing of the front end 67 of the upper plate 64. In FIG. 9, the sheet support member 61 and the end guide 62 that have moved forward are shown by a phantom line. As the front end 67 of the upper plate 64 is swung downward, the upper plate 64 moves backward. Therefore, the sheet support member 61 and the end guide 62 move backward in synchronization with the downward swing of the front end 67 of the upper plate 64.

Accordingly, the upper plate 64 is vertically swung while the distance between the front end 67 and the end guide 62 is maintained at substantially the same distance at all times. With this simple structure, a deviation of the sheets 3 can be prevented, so that the reliable and stable sheet feeding can be performed.

As the sheet support member 61 moves in synchronization with the swing of the front end 67 of the upper plate 64, the portion of the rear edge side of the sheet 3 stacked on the sheet support member 61 is free from the slide resistance. Therefore, reliable and stable sheet feeding can be performed.

The end guide 62 is provided on the sheet support member 61, so that the sheet support member 61 and the end guide 62 move forward together in synchronization with the vertical swing of the front end 67 of the upper plate 64. Therefore, reliable interlocking movement is obtained and the more stable sheet feeding is achieved.

Further, in the sheet cassette 52 of the invention, the interlock of the upper plate 64 and the sheet support member 61 is structured by the engagement of the rear edges 90 of the upper plate 64 and the slits 89 of the sheet support member 61. With this simple structure, the reliable interlocking movement is obtained.

Consequently, the laser printer 1 of the embodiment, including the sheet cassette 52, is capable of surely and stably performing sheet feeding and can achieve excellent image forming.

Figure 10:
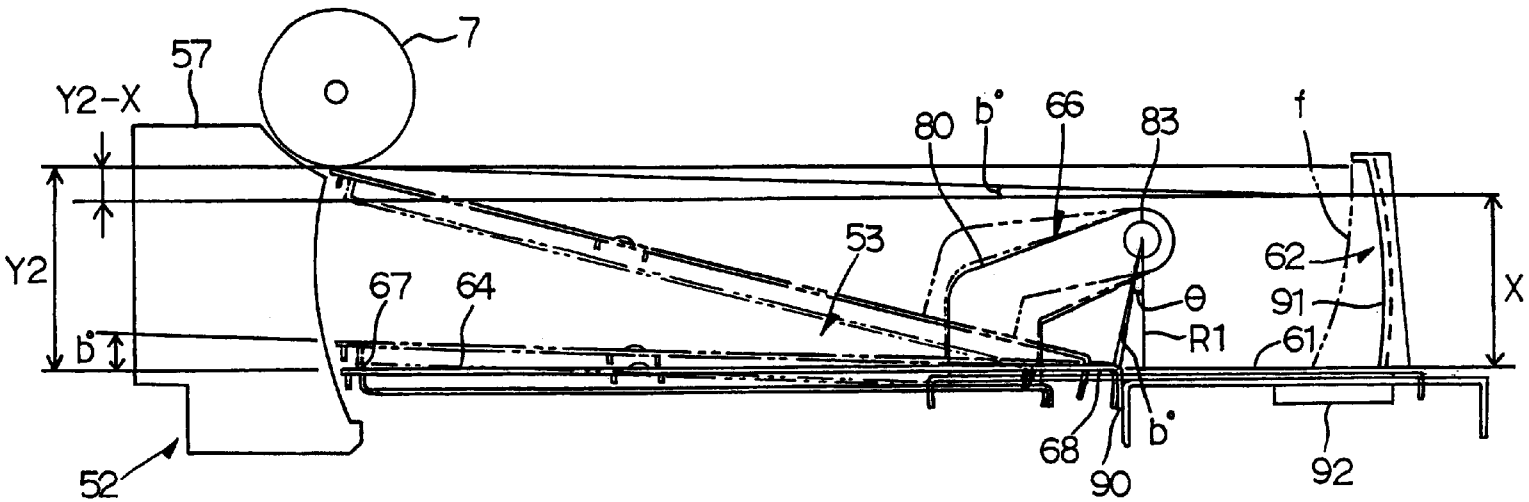
FIG. 10 is a side sectional view of essential parts for explaining a shape of a rear contact member of the end guide in the sheet cassette of FIG. 2.
Figure 11:
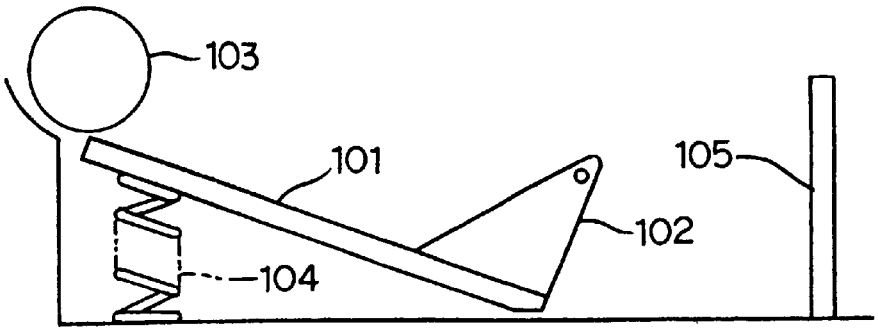
Fig.11 Related Art
FIG. 11 is a side view of essential parts of a conventional sheet feeder.
Figure 12:
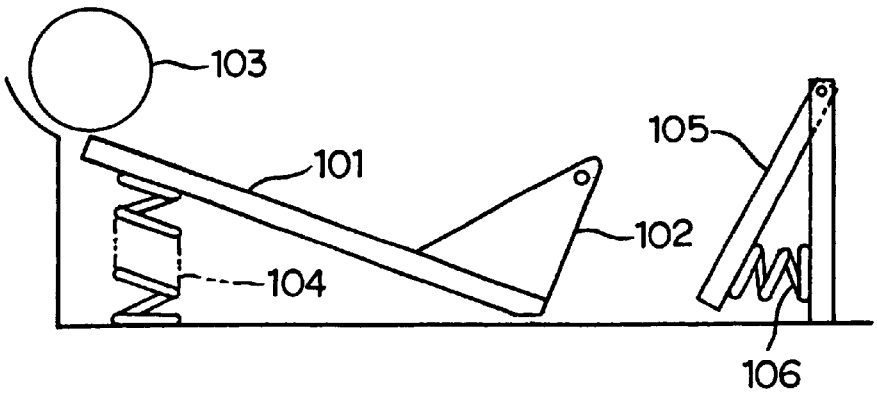
Fig.12 Related Art
FIG. 12 is a side view of essential parts of another conventional sheet feeder.

As shown in FIG. 10, the surface shape of the rear edge contact member 91 which contacts the rear edge of the sheets 3 is preferably formed such that the middle portion in its vertical direction is curved backward.

That is, in the sheet cassette 52 of the embodiment, the rear edge contact member 91 slides forward in synchronization with the swing of the front end portion 67 of the upper plate 64 upward as the stack of sheets 3 on the upper plate 64 is decreased in quantity. Therefore, the distance between the front end 67 of the upper plate 64 and the rear contact member 91 is maintained at substantially the same distance. However, the length in a horizontal direction of the uppermost sheet 3 actually fed is different according to a swing angle of the upper plate 64 when feeding the sheets 3. Accordingly, if the surface of the rear edge contact member 91 is not formed corresponding to the swing angle of the upper plate 64, the uppermost sheet 3 to be actually fed is excessively pressed due to the forward movement of the rear edge contact member 91. As a result, a malfunction, such that the sheet 3 is jammed at the sheet feed roller 7 or the sheet 3 cannot reach the sheet feed roller 7 even though the rear edge contact member 91 moves forward, may occur.

Therefore, as shown in FIG. 10, the surface shape of the rear edge contact member 91 which contacts the rear edge of the sheets 3 is formed such that the middle portion in its vertical direction is curved backward. By doing so, the front edge of the uppermost sheet 3 in the stack can be guided to an optimum point where the sheet 3 is always fed to the sheet feed roller 7 regardless of the stacking condition of the sheet 3, that is, regardless of the swing angle of the upper plate 64.

More particularly, the shape of the rear contact member 91 is determined so that a distance D between a point where the uppermost sheet 3 contacts the sheet feed roller 7 and a surface where the sheet 3 contacts the rear edge contact member 91 satisfies equations (1) and (2) below.

$$D=L+(R1\ \tan(b+\theta)-R1\ \tan\theta)+(0\text{–}5\ \text{mm}) \quad (1)$$

Where:

L: a length of the horizontal component of the uppermost sheet 3 to be stacked (mm);

R1: a length of a line segment of a normal dropping from a center of rotation of the swing shaft 83 of the upper plate 64 to the sheet support member 61 (mm);

b: a swing angle of the upper plate 64 from a reference angle θ; and

θ: the reference angle formed between the normal that drops from the center of rotation of the swing shaft 83 of the upper plate 64 to the sheet support member 61 and a line segment that connects the center of rotation of the swing shaft 83 and the rear edge 90 (the engaging position of the upper plate 64 and the sheet support member 61) of the upper plate 64 when the sheets 3 are fully stacked.

However, in the equation (1), L is a distance of the component of the uppermost sheet 3 in the stack in the only horizontal direction. L is expressed by the following equation (2).

$$L=(Y2-X)/\tan b+(a-(Y2-X)/\sin b) \quad (2)$$

Where:

Y2: a length between the upper surface of the upper plate 64 and the sheet feeding point where the sheet 3 is fed by the sheet feed roller 7 when the sheets 3 are fully stacked (mm);

X: a length between the upper surface of the upper plate 64 and the uppermost sheet 3 (mm);

b: the swing angle of the upper plate 64 from the reference angle θ; and a: the entire length of the sheet 3

That is, as the path of the rear edge of the sheet 3 is shown in a phantom line f, L varies according to the stacking condition of the sheets 3, that is, the swing angle of the upper plate 64. Therefore, the equation (1) is derived by adding the amount of forward movement of the horizontal component of the upper plate 64 at a swing angle b°, that is, (R1 tan(b+θ)−R1 tan θ), to L. That is, if the surface shape of the rear edge contact member 91 which contacts the rear edge of the sheets 3 is determined so that the position of the rear edge of the uppermost sheet 3 always satisfies the equation (1), the front edge of the uppermost sheet 3 can be positioned so as to be guided to the optimum point where the sheet 3 is always fed to the sheet feed roller 7, regardless of the stacking condition of the sheets 3, that is, regardless of the swing angle of the upper plate 64. Consequently, stable sheet feeding is achieved.

It is specified the deviation of the sheet 3 is 0 to 5 mm as shown in the equation (1) because it has proven the deviation within 5 mm does not interfere with stable sheet feeding.

The equation (1) is intended for the case where the rear edge 90 of the upper plate 64 is positioned ahead of the normal dropping from the center of rotation of the swing shaft 83 of the upper plate 64. When the rear edge 90 of the upper plate 64 is positioned behind the normal dropping from the center of rotation of the swing shaft 83 of the upper plate 64, an equation (3) below is applied as a substitute for the equation (1).

$$D=L+(R1\ \tan\theta-R1\ \tan(\theta-b))+(0\text{–}5\ \text{mm}) \quad (3)$$

In the explanation described above, the end guide 62 is structured to move in synchronization with the swing of the upper plate 64 via the sheet support member 61. However, the end guide 62 may be structured to move directly in synchronization with the upper plate 64 without moving or providing the sheet support member 61. Further, in the embodiment, the upper plate 64 and the sheet support member 61 are structured to move together by the engagement of the rear edges 90 of the upper plate 64 and the slits 89 of the sheet support member 61. However, a boss may be provided to either one of the upper plate 64 or the sheet support member 61, and a hole that engages the boss may be provided to the other so that the upper plate 64 and the sheet support member 61 are moved together by the engagement of the boss and the hole. As described above, the upper plate 64 and the sheet support member 61 may be moved together by any well-known engagement device.

What is claimed is:

1. A sheet feeder, comprising:

a stacking portion holding a stack of sheets thereof;

a swing portion vertically swinging the stacking portion;

an end guide, mounted to a support portion, rear edges of the sheets stacked on the stacking portion contacting the end guide, a rear edge of the stacking portion engaging the support portion such that the end guide moves back and forth in synchronization with the vertical swing of the stacking portion.

2. The sheet feeder according to claim 1, wherein the support portion supports rear portions of the sheets stacked on the stacking portion and the end guide is provided on the support portion at an end away from the engagement of the rear edge of the stacking portion to the support portion.

3. The sheet feeder according to claim 2, wherein the stacking portion has a bent portion at the rear edge, and the support portion has a slit that is engaged with the bent portion.

4. The sheet feeder according to claim 3, wherein a plurality of stoppers for positioning the end guide are provided to the stacking portion in accordance with sizes of the sheets to be stacked on the stacking portion.

5. The sheet feeder according to claim 4, wherein the stacking portion comprises an upper plate and a lower plate positioned below the upper plate, and the swing portion comprises an upper plate arm connected to the upper plate, a lower plate arm connected to the lower plate, and an arm holder by which the upper plate arm and the lower plate arm are supported.

6. The sheet feeder according to claim 5, further comprising a pair of side guides provided on both sides of the stacking portion, supporting both sides of the sheets to be stacked on the stacking portion wherein the side guides are slidable in accordance with the sizes of the sheets.

7. The sheet feeder according to claim 1, wherein a surface shape of the end guide where the rear edges of the sheets contact is curved backward at a middle portion in its vertical direction.

8. The sheet feeder according to claim 7, wherein the surface shape of the end guide where the rear edges of the sheets contact is determined so that a position of the rear edge of the uppermost sheet to be stacked on the stacking portion always satisfies an equation shown below:

$$L+(R1\ \tan(b+\theta)-R1\ \tan\theta)+(0\text{–}5\ \text{mm})$$

(when the rear edge of the stacking portion is positioned ahead of a normal dropping from a center of rotation of the stacking portion)

or $$L+(R1\ \tan\theta-R1\ \tan(\theta-b))+(0\text{–}5\ \text{mm})$$

(when the rear edge of the stacking portion is positioned behind of the normal dropping from the center of rotation of the stacking portion), where:

L: a length of the horizontal component of the uppermost sheet to be stacked on the stacking portion;

R1: a length of a line segment of the normal dropping from the center of rotation of the stacking portion to the support portion;

b: a swing angle of the stacking portion from a reference angle θ; and

θ: an angle formed between the normal dropping from the center of swing of the stacking portion to the support portion and a line segment that connects the center of swing of the stacking portion and the rear edge of the stacking portion when the sheets are fully stacked.

9. A sheet feeder, comprising:

an upper plate swingable vertically and holding a stack of sheets thereon;

a lower plate swingable vertically and disposed below the upper plate;

a first urging member urging the upper plate upward;

a second urging member urging the lower plate upward;

a first holding member holding the upper plate at the lowermost position against an urging force from the first urging member;

a second holding member holding the lower plate at the lowermost position against an urging force from the second urging member;

a pair of side guides slidable in accordance with the sizes of the sheets, supporting both sides of the sheets to be stacked on the stacking portion, and disposed at each side of a stacking portion; and a disengagement mechanism selectively disengaging the holding of the upper plate by the first holding member or the holding of the lower plate by the second holding member, in accordance with positions of the side guides.

10. A sheet cassette for-use in a print apparatus having a sheet cassette housing portion and a guide member mounted to each side of the sheet cassette housing portion, the sheet cassette comprising:

a grip portion;

a bottom plate;

a pair of side plates; and a rear plate, the grip portion, the bottom plate, the pair of side plates, and the rear plate defining a box-shaped cassette open at a top;

a sheet support member guide plate mounted to the bottom plate proximate the rear plate;

a sheet support member slideably mounted on the sheet support member guide plate, the sheet support member having a notch in each side edge;

a swing shaft mounted to each side plate and extending into the box shaped cassette, each swing shaft closer to the rear plate than each notch in the sheet support member;

a upper plate having a downwardly extending flange on each side at an end toward the rear plate, each flange engaged with a notch in the sheet support member;

an upper arm plate extending from each side of the upper plate to be pivotally mounted to the swing shaft at that side;

a lower plate;

a lower arm plate extending from each side of the lower plate at an end closest to the rear plate to be pivotally mounted to the swing shift at that side; and a plurality of pressure exerting devices mounted to the bottom plate proximate the grip portion, at least one pressure exerting device engaging the upper plate and at least one pressure exerting device engaging the lower plate.

11. The sheet cassette according to claim 10, wherein the pressure exerting devices are springs.

12. The sheet cassette according to claim 11, wherein three springs are provided, a center spring engaged with the lower plate and a spring on each side of the center spring engaged with the upper plate.

13. The sheet cassette according to claim 10, further comprising:

a pair of side guides slideably mounted to the upper plate; and a rear edge contact member slideably mounted to the sheet support member, wherein the side guides and rear edge contact member slide to contact print material mounted on the upper plate.

14. The sheet cassette according to claim 13, wherein the lower plate has an engagement protrusion at each side and a bottom side of each side guide has an engagement stepped portion, the engagement stepped portion engaging the engagement protrusion when the printed material has a width less than a predetermined width.

15. The sheet cassette according to claim 13, wherein the pair of side guides and the rear edge contact member are lockable in predetermined positions.

16. The sheet cassette according to claim 15, wherein the lockability of the pair of side guides and the rear edge contact member are provided by one of protrusions and notches provide in the slideable member and an opposite one of protrusions and notches provided in the sliding surface.

17. The sheet cassette according to claim 10, wherein the upper plate has an engagement plate extending at each side from a middle portion.

18. The sheet cassette according to claim 17, further comprising an upper plate holding member pivotally mounted to each side plate, the upper plate holding member having a notch for engaging the engagement plate on the same side of the sheet cassette of the upper plate and a contact protrusion extending through an opening in the bottom plate of the sheet cassette.

19. The sheet cassette according to claim 13, wherein the rear edge contact member has a concave surface.

20. A print apparatus, comprising:

a body having a sheet feeder housing portion; and a sheet feeder, comprising:

an upper plate swingable vertically and holding a stack of sheets thereon;

a lower plate swingable vertically and disposed below the upper plate;

a first urging member urging the upper plate upward;

a second urging member urging the lower plate upward;

a first holding member holding the upper plate at the lowermost position against an urging force from the first urging member;

a second holding member holding the lower plate at the lowermost position against an urging force from the second urging member;

a pair of side guides slidable in accordance with the sizes of the sheets, supporting both sides of the sheets to be stacked on the stacking portion, and disposed at each side of a stacking portion; and a disengagement mechanism selectively disengaging the holding of the upper plate by the first holding member or the holding of the lower plate by the second holding member, in accordance with positions of the side guides.

21. A print apparatus having a sheet cassette housing portion, comprising: a guide member mounted to each side of the sheet cassette housing portion, and a sheet cassette, comprising:

a grip portion;

a bottom plate;

a pair of side plates; and a rear plate, the grip portion, the bottom plate, the pair of side plates, and the rear plate defining a box-shaped cassette open at a top;

a sheet support member guide plate mounted to the bottom plate proximate the rear plate;

a sheet support member slideably mounted on the sheet support member guide plate, the sheet support member having a notch in each side edge;

a swing shaft mounted to each side plate and extending into the box shaped cassette, each swing shaft closer to the rear plate than each notch in the sheet support member;

a upper plate having a downwardly extending flange on each side at an end toward the rear plate, each flange engaged with a notch in the sheet support member;

an upper arm plate extending from each side of the upper plate to be pivotally mounted to the swing shaft at that side;

a lower plate;

a lower arm plate extending from each side of the lower plate at an end closest to the rear plate to be pivotally mounted to the swing shift at that side; and a plurality of pressure exerting devices mounted to the bottom plate proximate the grip portion, at least one pressure exerting device engaging the upper plate and at least one pressure exerting device engaging the lower plate.

* * * * *